United States Patent [19]

Kobayakawa et al.

[11] Patent Number: 4,816,716

[45] Date of Patent: Mar. 28, 1989

[54] CHIP-LESS FLAT DISPLAY PANEL

[75] Inventors: Masaki Kobayakawa, Tokyo; Yo Takasaki; Hiroshi Saeki, both of Kagoshima, all of Japan

[73] Assignee: NEC Corporation, Tokyo, Japan

[21] Appl. No.: 90,993

[22] Filed: Aug. 31, 1987

[30] Foreign Application Priority Data

| | | | |
|---|---|---|---|
| Aug. 29, 1986 | [JP] | Japan | 61-204939 |
| Sep. 8, 1986 | [JP] | Japan | 61-138410[U] |
| Sep. 19, 1986 | [JP] | Japan | 61-143672[U] |

[51] Int. Cl.[4] ..... H01J 5/02; H01J 17/16

[52] U.S. Cl. ..... 313/496; 313/634; 220/2.1 R

[58] Field of Search ..... 313/493, 495, 496, 582, 313/586, 584, 634; 220/2.1 R, 2.3 R

[56] References Cited

U.S. PATENT DOCUMENTS

| | | | |
|---|---|---|---|
| 2,643,020 | 6/1953 | Dalton | 313/634 X |
| 3,897,614 | 8/1975 | Armstrong | 313/496 X |

FOREIGN PATENT DOCUMENTS

| | | | |
|---|---|---|---|
| 2549737 | 6/1976 | Fed. Rep. of Germany | 313/582 |

*Primary Examiner*—Leo H. Boudreau
*Assistant Examiner*—K. Wieder
*Attorney, Agent, or Firm*—Sughrue, Mion, Zinn, Macpeak & Seas

[57] ABSTRACT

A flat fluorescent display panel, having in parallel an anode plate and a cover plate separated by a frame-type spacer whose central open area defines an inner space for a fluorescent material and electrode structure. The three layers are joined and sealed together such that the inner space may be evacuated. The cover is cut or slit, forming an opening that expose the inner space and permits evacuation. The opening is closed and sealed by a portion of the cover or some suitable sealing structure.

9 Claims, 5 Drawing Sheets

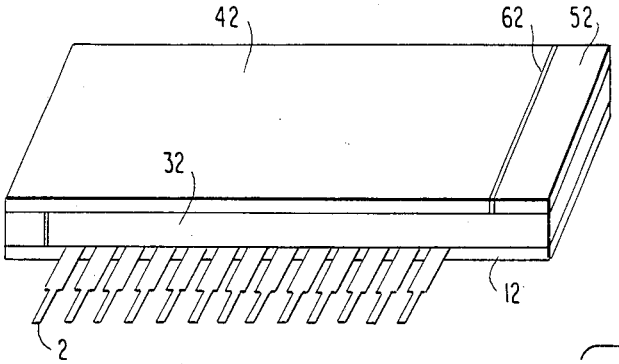
FIG.4
FIG.5A
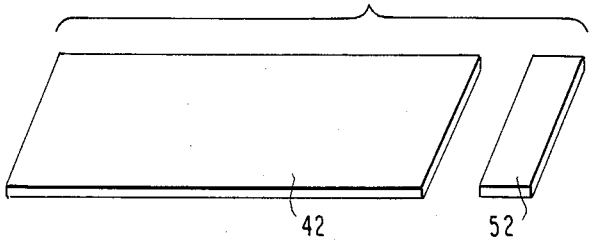
FIG.5B
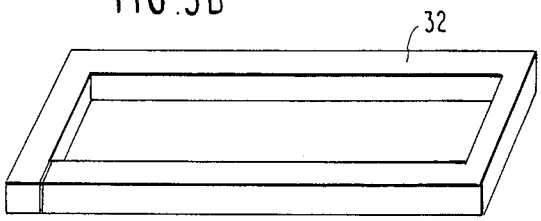
FIG.6
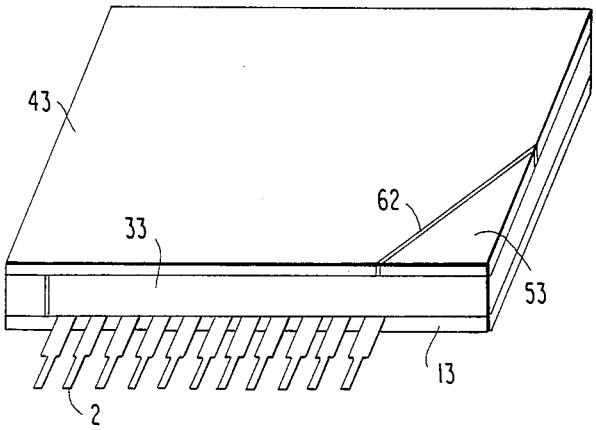
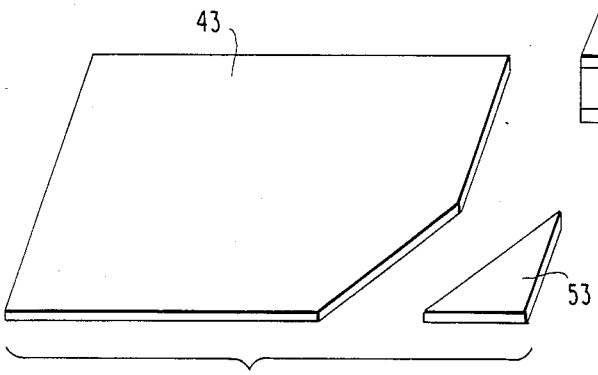
FIG.7A
FIG.7B
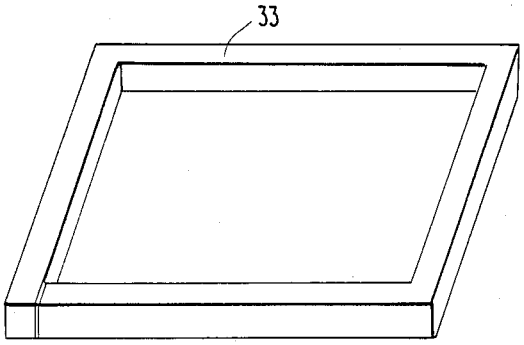

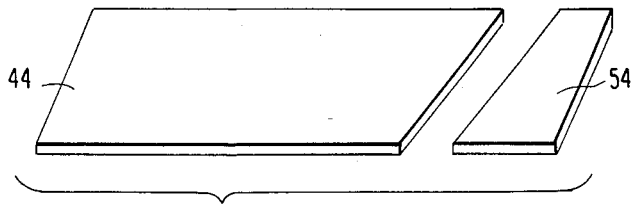
FIG. 8
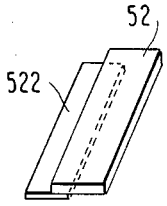
FIG. 10A
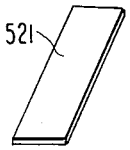
FIG. 9A
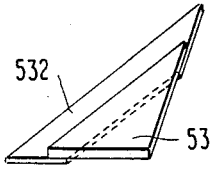
FIG. 10B
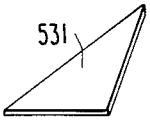
FIG. 9B
FIG. 11
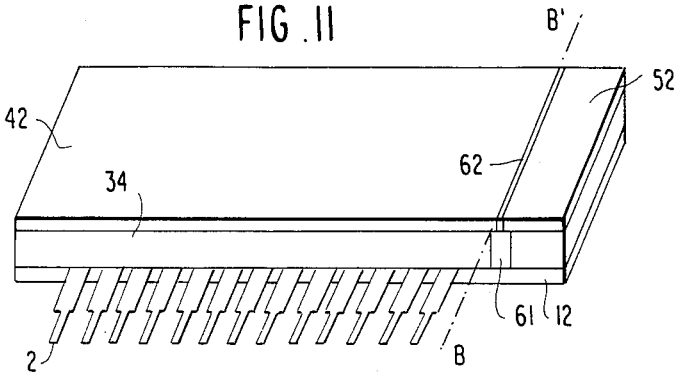
FIG. 12A
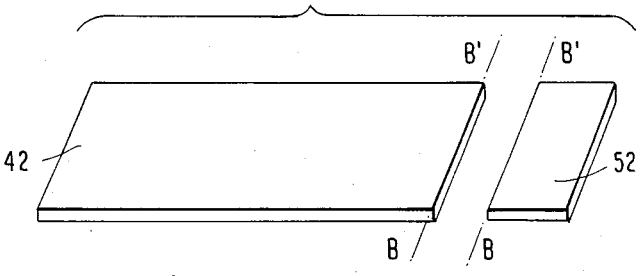
FIG. 12B
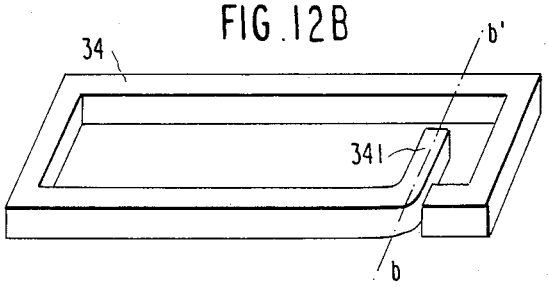

CHIP-LESS FLAT DISPLAY PANEL

BACKGROUND OF THE INVENTION

This invention relates to a flat display panel, and more particularly to a sealing structure for a flat display panel such as a fluorescent display panel or a gas discharge tube which is hermetically sealed without a chip tube for exhausting air.

In the prior art, a flat display panel was provided with a chip tube projected therefrom for air exhaustion, but in recent years there have been demands for chip-less display panels.

Japanese Patent Application laid-open No. Sho 60-202637 laid open on Oct. 14, 1985 discloses a fluorescent display panel having a chip-less structure. In the disclosure initially, a through-hole is opened in the glass plate of an envelope. Then, after the inner electrodes are fabricated, the envelope is placed in a vacuum chamber and the through-hole is hermetically sealed in vacuum with a cover plate comprising a glass disk having a surface area larger than that of the through-hole.

This prior art chip-less display panel has the following defects.

(1) For exhausting air, the through hole must be bored either on an anode substrate or on a plate of the hermetically sealed envelope arranged opposite thereto. When the hole is bored on a glass plate of either the anode substrate or the opposite plate, an oil of high viscosity is used in order to prevent cracks and/or notches of the glass plate. Since the oil will stain the glass plate, a strong detergent is used to cleanse it. All these extra steps make the manufacturing process more complicated, and increase the manufacturing costs. Moreover, the super hard drill used in the manufacturing process is easily worn and further increases costs.

(2) The peripheral portion of the hole bored in the glass plate is prone to cracks, even if precautions are taken for working conditions. When the plate is heated to hermetically seal the envelope, cracks often occur and debris may adhere to the display segments made of a fluorescent material layer, thereby impairing the luminance thereof. As a result black spots will appear on the display and may result in defective indication by the display.

(3) Where a cover plate, comprising a flat glass disk is used to seal the hole, the cover plate protrudes from the sealed envelope.

SUMMARY OF THE INVENTION

An object of this invention is to provide a chip-less display panel with a structure which is manufactured by a process that does not involve a step requiring the opening of a hole in a glass plate.

Another object of this invention is to provide a flat type display panel of chip-less structure which has no projection and is easily manufactured.

According to this invention, two flat plates are placed in parallel upon the opposite primary surfaces of a spacer member to form an envelope. One of the plates is shortened to form a step with the spacer member or is cut into two portions to form a slit therebetween. Air is exhausted from the step or slit, and the spare is sealed.

BRIEF DESCRIPTION OF THE DRAWINGS

FIG. 4 is a perspective view to show the second embodiment of this invention.

FIGS. 5A and 5B are partially cutaway perspective views of FIG. 4.

FIG. 6 is a perspective view of the third embodiment of this invention.

FIGS. 7A and 7B are partially cutaway perspective views of FIG. 6.

FIG. 8 is a perspective view to show the fourth embodiment of a cover plate according to this invention.

FIGS. 9A and 9B and FIGS. 10A and 10B are perspective views to show other modifications of the cover plate.

FIG. 11 is a perspective view to show the fifth embodiment of this invention.

FIGS. 12A and 12B are partially cutaway perspective views of FIG. 11.

DETAILED DESCRIPTION OF THE PREFERRED EMBODIMENTS

Figure 1:
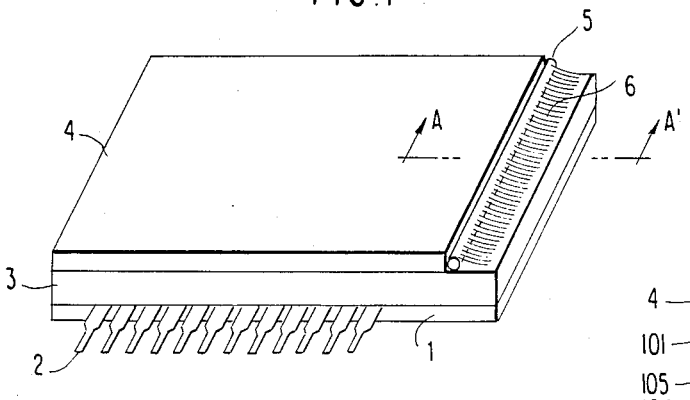
FIG. 1 is a perspective view to show the first embodiment of this invention.

An application of this invention is a fluorescent display panel is now described referring to the drawings.

Referring to FIGS. 1A, 2A and FIGS. 3A–3C, an envelope of a fluorescent display panel comprises a pair of insulating plates 1 and 4, one 1 being an anode substrate and the other 4 being a cover plate, and a frame-shaped spacer 3 held therebetween. Display electrodes 103 (segments) having a fluorescent material layer 104 are formed on the anode substrate 1. The electrodes 103 are connected to internal wiring layers 108 provided below an insulating layer 107 and led-out from the envelope via a group of external leads 2. A group of external leads 2 are held between the spacer 3 and the anode substrate 1 and sealed therein with sealing material such as soldering glass which connects the spacer 3 to the substrate 1. The cover plate 4 is hermetically fixed to the spacer 3 with soldering glass. In this embodiment, one side of the cover plate 4 is cut off to shorten the length of the cover plate 4 to such extent that the length is less than the length of the substrate 1 by a value little more than the width of the spacer 3. Thus, a slit W is formed between the spacer 3 and the cut-down side of the cover plate 4 as shown in FIG. 2B. An elongated opening, or a slit, thus formed is used to exhaust air inside the envelope. A glass rod or a like insulating rod 5 is used as a sealing member to close the slit and is sealed with soldering glass 6 (see FIG. 2A).

The outer diameter of the insulating rod 5 is determined to be larger than the space W of the slit and not greater than the thickness of the cover plate. The length thereof is selected to be long enough to cover the elongated opening of the slit and not to protrude from the envelope. The insulating rod 5 may be in the form of a rod as shown in FIG. 2C or of a pipe 7 as shown in FIG. 2D.

Figure 2A:
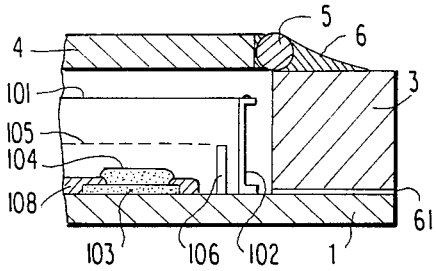
FIG. 2A is a cross sectional view of FIG. 1
Figure 2B:
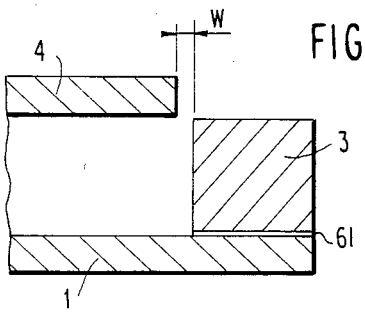
FIG. 2B is a cross sectional view before a slit is sealed.
Figure 2C:
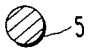
FIGS. 2C and 2D are cross sections of sealing members to be applied to the structure of FIG. 2B.
Figure 2D:
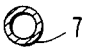

As shown in FIG. 2A, when the electrode is of mesh pattern or transparent, the anode substrate 1 is made to be transparent so as to be observed from the side of the anode substrate 1. To this end, usually a plate of glass is used for the anode substrate. Needless to say, observation can be done from the side of the cover plate 4 by using a glass plate for the plate 4. The other surface or the side not indicating may be of a ceramic plate, but a glass plate is usually used to reduce a cost. With a sealing member 5 or 7 in the form either of a rod or a pipe to close the air-exhausting slit, the fluorescent display panel of FIG. 1 has no portion protruding from a hermetically sealed envelope.

Figure 3A:
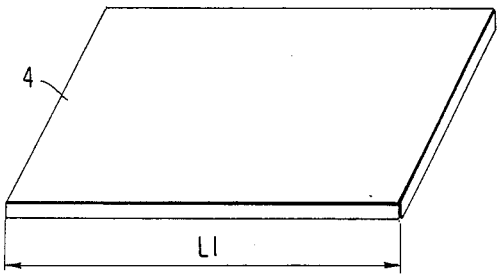
FIGS. 3A through 3C are cutaway perspective views of essential portions of an envelope of the first embodiment of this invention.
Figure 3B:
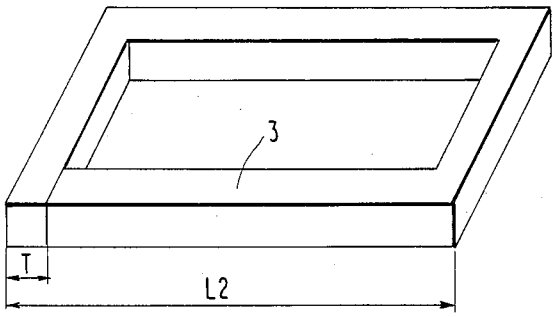
Figure 3C:
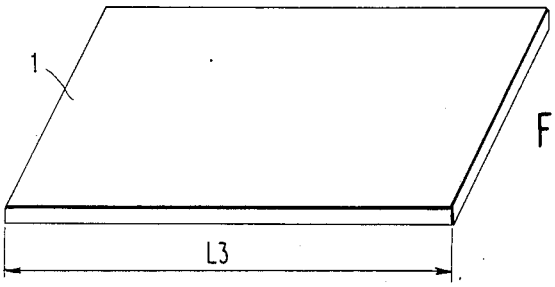

This structure can also minimizes the size of necessary components. The hermetically sealed envelope can be composed of the anode substrate 1, the cover glass plate 4, the spacer 3 and the sealing member 5. As shown in FIGS. 3A to 3C, length $L_1$ of the cover plate 4 is shorter than the value of $L_2-T$ by W, wherein $L_2$ represents the length of the spacer 3 and T represents the frame width of the spacer 3. The length $L_3$ of the anode substrate, is selected to be equal to or larger than the length $L_2$.

The sealing process with soldering glass 6 is advantageous. As the glass rod 5 has a circular section, sealing process starts from the portions of linear contact with the end wall of the cover plate 4 and the upper surface of the spacer 3 to gradually proceed to other portions. This procedure can eliminate automatically the problem in strength which might otherwise be caused from the difference in thickness between soldering glass on interfaces in the case of surface-to-surface contact. More specifically, this structure can obviate the problem that the strength in adherance will be weaken when the thickness of the soldering glass 6 is less than a certain value. In the process of melting the soldering glass 6, the soldering glass can seal snugly and completely one object with another object due to the effect of its surface tension.

Problems otherwise caused with powder of soldering glass can be reduced by pre-sintering process after applying at least a portion of soldering glass for sealing on the cover member 5 which is either a rod or a pipe.

In the above embodiment, an insulating rod is used as the sealing member, but as shown in FIG. 4, a cover plate 52 of a rectangle may be used. More particularly, as shown in FIGS. 5a and 5B, one end of an insulating plate 42 having the dimension large enough to cover the entire spacer 32 is cut off to form a rectangle as the cover plate 52. The slit for exhausting air in this embodiment is therefore in the form of a rectangle. The slit between the cover plate 52 and an insulating plate 42 is filled with sealing material 62 to be sealed. The anode substrate 12 on the side of electrodes is similar to one shown in FIG. 1 and FIG. 2A.

In the embodiment shown in FIG. 6, a cover plate 53 is shaped as a triangle. This can be obtained by cutting one corner of an insulating plate 43 as shown in FIGs. 7A and 7B. In the case like this embodiment where the dimension of the envelope is relatively large, it is preferable to select a triangle for the configuration of the exhausting slit which should be formed by notching off a glass plate covering entire region of the spacer 33 to produce the insulating plate 43 and cover plate 53. In the case of a rectangular envelope as shown in FIG. 4, a glass plate covering entire region of the spacer 32 may be notched in parallel to a shorter side thereof to produce the insulating plate 42 and cover plate 52.

An application of a flat cover plate is by no means limited to the above-mentioned embodiments. For instance, an insulating plate covering entire spacer 34 may be cut diagonally at one end thereof to form an insulating plate 44 and a cover plate 54 in the form of a trapezoid as shown in FIG. 8.

Instead of cutting off a portion of an insulating plate, a cover plate may be a rectangular metal cover plate 521 or a triangle metal cover plate 531 which are separately prepared to correspond the cover plate 52 or 53 as shown in FIGS. 9A and 9B. Metal supporting members 522 and 532 may be connected in advance to the cover plates 52 and 53 as shown in FIGS. 10A and 10B.

The embodiment shown in FIG. 11 has an almost similar appearance to the one shown in FIG. 4, except that a spacer 34 is bent inward into a frame at one end thereof 341 a shown in FIGS. 12A and 12B, and the extension line thereof b—b' coincides with the cutting line B—B' between the insulating plate 42 and the cover plate 52. By molding the spacer to correspond to the cutting line of the cover plate, shavings or dust of soldering glass and glass plate can be prevented from entering the envelope in the sealing process.

Figure 13:
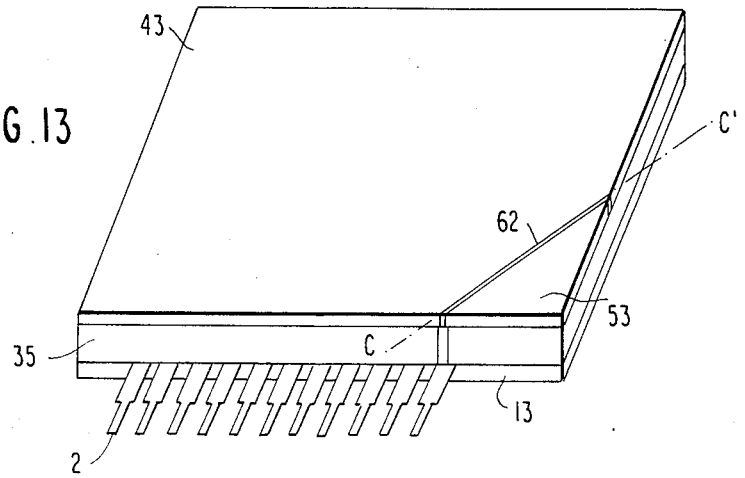
FIG. 13 is a perspective view to show the sixth embodiment of this invention.
Figure 14A:
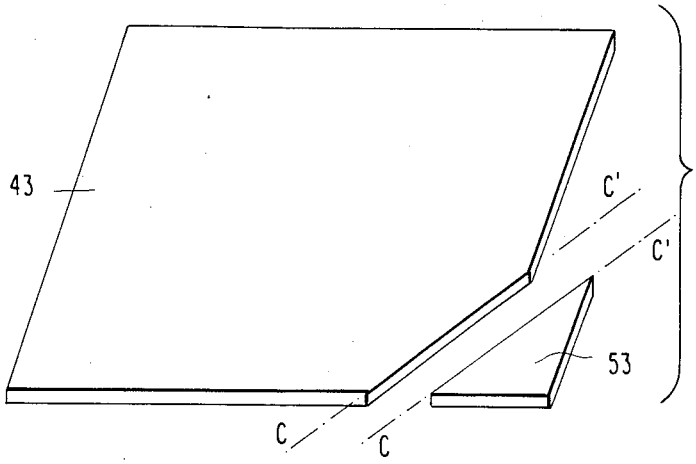
FIGS. 14A and 14B are partially cutaway perspective views of FIG. 13.
Figure 14B:
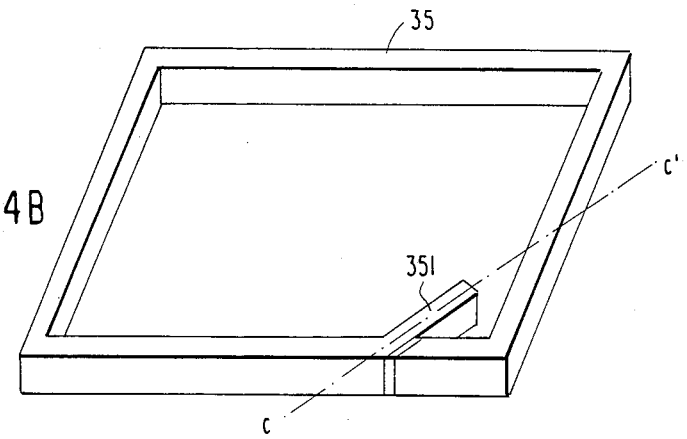

The embodiment shown in FIG. 13 is almost similar to the one shown in FIG. 6 in appearance except that a spacer 35 is bent at one end 351 thereof toward inside as shown in FIGS. 14A and 14B to extend along the line c—c' which coincides with the cutting line C—C' in FIG. 13.

Figure 15A:
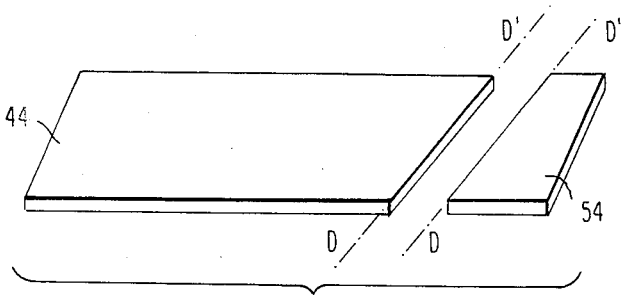
FIGS. 15A and 15B are perspective views to show the seventh embodiment of this invention.
Figure 15B:
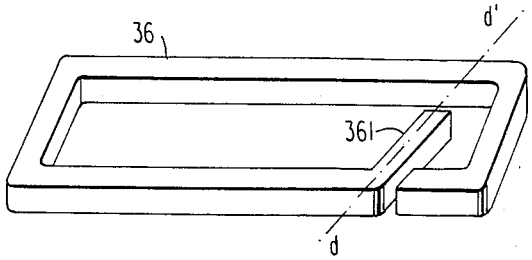

FIGS. 15A and 15B show the configuration of a spacer 36 for the case where a cover plate shown in FIG. 8 is used. The spacer 36 is bent toward inside at one end 361 thereof to extend along the line d—d' which agreed with the cutting line D—D'.

Referring to FIG. 16, for example of manufacturing process of the fluorescent indicator panel having the structure shown in FIG. 4 will be described.

Figure 16A:
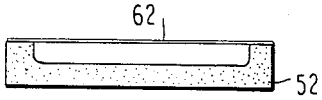
FIGS. 16A and 16B are plan view and front view to show an inner cover plate provided with glass-solder paste.
Figure 16B:
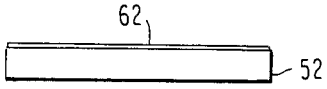
Figure 17:
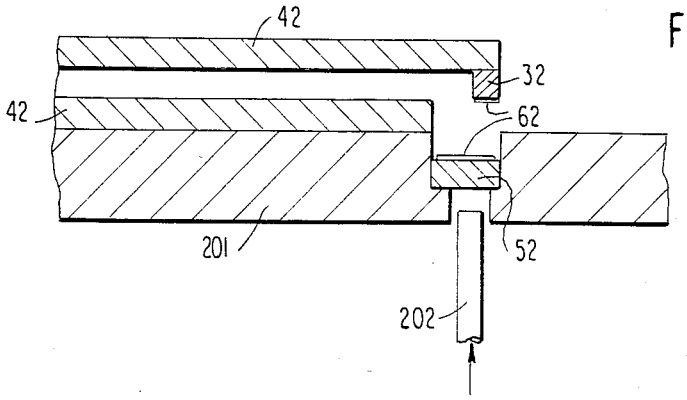
FIG. 17 is a cross sectional view to show how the inner cover plate is placed in an envelope in a vacuum chamber.

As shown in FIGS. 16A and 16B, a plain view and a front view of a cover plate 52, respectively, a surface of cover plate 52 to be sealed is applied with solder glass paste on the region facing the spacer 32 and the section facing the end of the insulating plate 42, and subsequently pre-sintered. As shown in FIG. 17, the spacer 32 and the insulating plate 42 are applied with solder glass paste 62 on the surfaces facing the cover plate 52 similarly, and then are pre-sintered.

These are placed at predetermined positions inside a vacuum chamber (not shown). For instance, as shown in FIG. 17, essential portions of an envelope are sealed in advance on a panel and then positioned in the panel with an exhausting slit on a supporting plate 201 having a recess to house the cover plate 52. The vacuum chamber is exhausted of air, and then a pushing rod 202 is inserted through an opening bored on the bottom of the recess and is pushed in the direction indicated with an arrow mark to press the cover plate 52 onto the spacer 32. Then the pre-sintered solder glass 62 is heated to seal the exhausing slit. It is preferable that the melting point of the pre-sintered solder glass 62 is lower than that of solder glass used to seal the other portion of the envelop by the value of 50° to 80° C.

In an ordinary fluorescent display panel, since filament supporters are located at both end portion of the panel, cover member of the present invention does not disturb the observation of display.

In the foregoing description, although the present invention has been applied to the fluorescent display panel, a gas discharge display panel can also employ the present invention by providing an exhausting port at the place where the electrodes are not provided.

This invention can achieve the following effects.

(1) It enables manufacture of a display panel which is substantially in a box form without projections at a high yield and at low cost so as to provide a display panel of chip-less type which is easily packaged on devices.

(2) As the processing and working of the components of a chip-less type display panel can be simplified, the manufacturing process can be automated or mechanized. As the problem heretofore caused by powder and dust can be obviated, the manufacturing yield can be improved and the cost can be lowered to provide a highly reliable display panel.

The present invention has been described in the foregoing statement by referring to the embodiments shown in attached drawings, but the position of the exhaust air port may be on the side of the longer side of an insulating plate or of the electrode substrate in respective embodiments. By selecting the position alone, eight variations and modifications will be possible. The present invention is therefore by no means limited by the particular position of the air exhaust slit.

What is claimed is:

1. A chip-less flat display panel, having first and second major surfaces, and an edge portion joining said surfaces, said panel comprising:

a spacer member having a frame-type structure at least surrounding a central open area, said frame having an inner edge defining said central open area, a first outer edge forming a part of the panel edge portion and first and second edge surfaces coincident with said first and second major surfaces, a first plate having a first perimeter edge forming a part of the panel edge portion and being fixed to the entire first edge surface of said spacer member such that the central open area is totally covered, a second plate having a second perimeter edge forming a part of the panel edge portion and being fixed to a substantial portion of the second edge surface of said spacer member, said second plate being dimensioned such that a part of said perimeter edge is recessed from said inner edge of said spacer member so as to be disposed above said central open area, thereby creating an opening defined by the inner edge of said spacer member and said part of the second perimeter edge of said second plate while covering a substantial portion of said central open area, and a cover member sealed to both said part of said second perimeter edge of said second plate and said second edge surface of said spacer member in a manner to cover said opening by using a sealing material in addition to said cover member, the configuration of said cover member being sized so as not to protrude from the outer periphery of said spacer member and having a thickness so as not to be larger than the thickness of said second plate.

2. A panel as claimed in claim 1, wherein said cover member has the shape selected from the group consisting of a rod or a tube.

3. A panel as claimed in claim 1, wherein said cover member and said second plate are made by cutting a plate which has a dimension larger than said central open area of said spacer member but smaller than that defined by said first outer edge of said spacer member.

4. A panel as claimed in claim 3, wherein said spacer member has a protruding portion extended within said central open area of said spacer member along the second perimeter edge of said second plate defining said opening.

5. A panel as claimed in claim 1 wherein said envelope contains material for causing said panel to illuminate.

6. A panel as claimed in claim 1 wherein said first plate is an anode, said second plate is an insulator and said cover member is a metal.

7. A panel as claimed in claim 6 wherein said cover member comprises a first planar member disposed coplanar with said second plate and a second planar member attached to said first member and projecting inward toward said central open area and extending parallel to said second plate and under the edge of said second plate defining said opening.

8. A chip-less fluorescent flat display panel comprising an anode substrate provided with anode electrodes and having fluorescent material deposited on one surface thereof, a spacer member of a frame type surrounding a central open area and having a protruding portion extending within said central open area, such that said central open area is partly separated into major open area and minor open area, said spacer member having first and second oppositely disposed sides and an inner surface extending between said first and second sides, said first side being fixed to said anode substrate, a first cover plate fixed to said second side of said spacer member such that said major open area is totally covered while said minor open area is exposed as an opening for exhausting air, a second cover plate fixed to said second side of said spacer member such that said second opening is totally covered, a boundary between said first cover and said second cover forming a slit disposed on said protruding portion of said spacer member, and a sealing material filled within said slit to form a hermetic envelope.

9. A chip-less flat display panel comprising a spacer member of a frame type and having a first and a second contact surfaces, said spacer member having an inner surface extending between said first and second contact surfaces and surrounding a central open area, a first plate fixed to the entire first contact surface of said spacer member such that said central open area is totally covered, a second plate fixed to the major part of said second contact surface of said spacer member such that the major part of said central open area is covered to create an opening for exhausting air therethrough defined by said inner surface of said spacer member and said second plate, a third plate fixed to the remaining minor part of said second contact surface of said spacer member such that said opening is totally covered, said third plate having the same thickness of said second plate and being disposed coplanar with said second plate, and a sealing material filled within the slit formed between said second plate and said third plate.

* * * * *